US005805288A

United States Patent [19]

Simmons et al.

[11] Patent Number: 5,805,288

[45] Date of Patent: Sep. 8, 1998

[54] APPARATUS FOR DETECTING THE PRESENCE AND LOCATION OF AT LEAST ONE OBJECT IN A FIELD

[75] Inventors: George R. Simmons, Haddon Heights, N.J.; Edmond J. Dougherty, Stafford, Pa.

[73] Assignee: Laserscore, Inc., Willow Grove, Pa.

[21] Appl. No.: 800,301

[22] Filed: Feb. 13, 1997

Related U.S. Application Data

[63] Continuation-in-part of Ser. No. 611,009, Mar. 5, 1996, abandoned.

[51] Int. Cl.[6] ..... G01B 11/03

[52] U.S. Cl. ..... 356/375; 250/222; 250/222.1

[58] Field of Search ..... 356/375; 250/222, 250/222.1

[56] References Cited

U.S. PATENT DOCUMENTS

| | | |
|---|---|---|
| 3,047,723 | 7/1962 | Knapp . |
| 3,401,937 | 9/1968 | Rockwood et al. . |
| 3,508,752 | 4/1970 | Lemon . |
| 3,619,630 | 11/1971 | McLeod et al. . |
| 3,727,069 | 4/1973 | Crittenden, Jr. et al. . |
| 3,807,858 | 4/1974 | Finch . |
| 4,266,124 | 5/1981 | Weber et al. . |
| 4,553,842 | 11/1985 | Griffen . |
| 4,743,769 | 5/1988 | Schwaiger et al. . |
| 4,746,770 | 5/1988 | McAvinney . |
| 4,762,990 | 8/1988 | Caswell et al. . |
| 4,789,932 | 12/1988 | Cutler et al. . |
| 4,855,590 | 8/1989 | Bures et al. . |
| 4,877,970 | 10/1989 | Minamikawa et al. . |
| 5,243,183 | 9/1993 | Barron, Jr. et al. . |
| 5,281,809 | 1/1994 | Anderson et al. . |
| 5,448,362 | 9/1995 | Perchak . |
| 5,454,016 | 9/1995 | Holmes . |
| 5,462,283 | 10/1995 | Allen . |
| 5,493,112 | 2/1996 | Welch . |
| 5,499,283 | 3/1996 | Toki . |
| 5,540,445 | 7/1996 | Lee . |
| 5,565,686 | 10/1996 | Welch . |

FOREIGN PATENT DOCUMENTS

| | | |
|---|---|---|
| 1449050 A | 11/1973 | Australia . |
| 0 182 397 A | 5/1986 | European Pat. Off. . |
| 0 525 733 A1 | 7/1992 | European Pat. Off. . |
| WO 83/00920 | 3/1983 | Germany . |
| 42 07 497 A1 | 3/1992 | Germany . |
| 2-44198 A | 2/1990 | Japan . |
| 2 159 269 | 5/1984 | United Kingdom . |
| 2 196 114 | 4/1988 | United Kingdom . |
| WO 87/05688 | 9/1987 | WIPO . |

OTHER PUBLICATIONS

EP Search Report—PCT/US97/03264.

*Primary Examiner*—Frank G. Font
*Assistant Examiner*—Zandra V. Smith
*Attorney, Agent, or Firm*—Panitch Schwarze Jacobs & Nadel, P.C.

[57] ABSTRACT

An apparatus for detecting the presence of at least one object in a field having at least one through-beam detection device with at least one transmitter and at least one opposing detector to create a detection beam that overlaps the field.

41 Claims, 9 Drawing Sheets

APPARATUS FOR DETECTING THE PRESENCE AND LOCATION OF AT LEAST ONE OBJECT IN A FIELD

BACKGROUND OF THE INVENTION

This application is a continuation-in-part of application Ser. No. 08/611,009 filed Mar. 5, 1996, now abandoned.

1. Technical Field

The invention relates to the use of radiation emitting and detecting devices positioned to detect the presence and location of at least one object in a field. An interruption of the radiation from a transmitter caused by the presence of the object in the field is sensed by a detector. The information derived from that interruption can then be used to locate the position of the object in that field. Finally, that information can be used to correlate the object's exact position on the surface of an object adjacent the field.

2. Description of the Related Art

The use of energy or radiation emitting transmitters and receivers or detectors to detect and to locate an object in a field and adjacent surface are well known. Such a system, especially useful for detecting the presence and location of darts in a dart board, is disclosed in WO 87/05688, entitled Dart Scorer. These systems, however, all suffer from the same deficiencies, inaccurate readings, high costs, poor design, unreliability, and complexity. What is needed is a reliable and highly accurate object detection and location apparatus that is inexpensive enough for home use and durable enough for use by the general public.

SUMMARY OF THE INVENTION

The present invention is directed to an apparatus or device for detecting the presence and location of at least one object in a field that overcomes one or more of the problems associated with the related art. The information derived about the object's location in the field preferably is then used to pinpoint that object's location on a surface adjacent to the field.

The objects and advantages of the invention will be set forth in part in the specification which follows and in part will be obvious from the description, or may be learned by practice of the invention. The objects and advantages of the invention may be realized and attained by means of the instrumentalities and combinations particularly pointed out in the claims.

To achieve the above objects and in accordance with the purpose of the invention, as embodied and broadly described herein, there is disclosed an apparatus for detecting the presence of at least one object in a field having at least one through-beam detection device with at least one transmitter and at least one opposing detector to create a detection beam that overlaps the field. The apparatus also includes means for moving the through-beam detection device around the field so that the detection beam rotates about the field to permit the detection of the object(s) in the field.

In another aspect of the invention there is disclosed an apparatus for detecting the presence and location of at least one dart in a dart board surface having at least one through-beam detection device with a detection beam that overlaps a field adjacent the dart board's surface. The apparatus also includes means for moving the through-beam detection device around the field so that the detection beam rotates about the field to permit the detection of the dart(s) in the field.

The dart's position in the dart board surface is then determined from its position in the field adjacent to the surface, and a score is assigned to the dart's position.

It is to be understood that the general description above and the following detailed description are exemplary and explanatory and are intended to provide a further explanation of the invention. The accompanying drawings also are included to provide a further understanding of the invention and are incorporated in and constitute a part of the specification, illustrate several embodiments of the invention, and together with the description serve to explain the principles of the invention.

DESCRIPTION OF THE PREFERRED EMBODIMENTS

Figure 1:
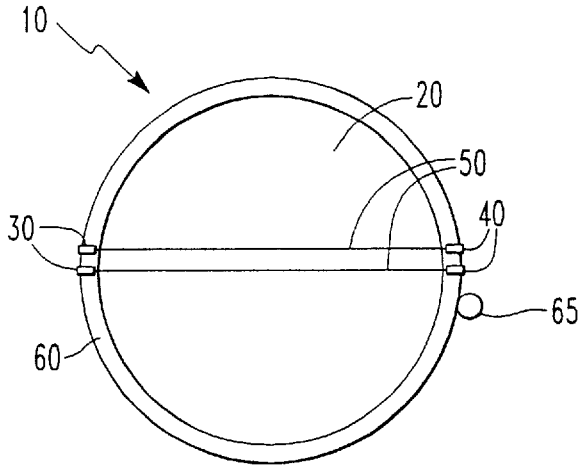
FIG. 1 is a front view schematic illustration of one embodiment of the invention for use in the detection of objects in a circular field.

Reference will now be made to the present preferred embodiments of the invention, examples of which are illustrated in the accompanying drawings. An exemplary embodiment of the apparatus of the present invention is shown in FIG. 1, and is designated generally by reference numeral 10. Referring to FIG. 1, there is provided an apparatus for detecting the presence and location of at least one object in a field 20, comprising at least one transmitter 30 and at least one opposing detector 40 to create a detection beam 50 that overlaps the field 20. In the context of the present invention the term "overlaps" is meant to be synonymous with "covers," "encompasses," or "projects across." As shown in FIG. 1, there are two transmitters 30 and two opposing detectors 40. For purposes of this invention, the transmitter and opposing detector are collectively referred to herein as a through-beam detection device. The transmitter 30 and opposing detector 40 are mounted on a ring 60 that is capable of rotating and which is driven, for example, by a motor-driven wheel 65.

For ease of illustration, the field shown in FIG. 1 is circular. It is envisioned that any size or shape field may be monitored by the present invention without departing from the invention, including two and three dimensional fields. It will also be apparent to those skilled in the art in view of the invention disclosed herein that more than one through-beam detection device (at least one transmitter 30 and at least one opposing detector 40) may be mounted on the ring to provide additional capability to detect the location of an object in the field. The ring is rotated to allow the detection beam 50 overlapping the field to rotate relative to the field and effectively cover the entire field to be scanned with at least one detection beam. Ideally, the field that is being monitored by the through-beam detection device is adjacent a surface, such as dart board surface, and the information that is obtained is used to determine an object's exact location in that surface.

In accordance with the invention, the relative position of the through-beam detection device should be known relative to a fixed point or points so that its position and hence an object's position that it detects can be determined. This is accomplished by using means that measure the angular displacement of the through-beam detection device relative to at least one fixed point, for example by using an indexing sensor. Such means are described in further detail below.

For example, in the embodiment in which the field being detected is circular (for example, the field being detected is adjacent a dart board surface), the angle of the through-beam detection device is measured relative to 20 fixed points on the circumference of the circle at the moment an object is detected. Each fixed point is located 18 degrees from each other around the circumference. In the case of a dart board, the fixed points relate to the 20 segments of the dart board. The angle can be determined in a number of ways using sensors, encoders, combinations thereof, or the like. In one embodiment, reflectors are placed on the rotating ring. A fixed retro-reflective sensor such as OPB703A, manufactured by TRW, located off the ring is used to sense the presence of the reflectors on the ring each time they pass. In this manner, indexing signals are produced. One of the reflectors is distinguished from the others to produce a once per revolution index. The reflector might be wider or split into two as a means to differentiate it from the other reflectors.

If a single indexing sensor is employed, the speed of the rotating ring should be kept constant during each complete revolution of the ring around the field but may vary from one revolution to the next. As used in the present application, the term "constant" is relative to the required accuracy for a given application or use. For a single indexing sensor, the absolute position of the rotating elements is only known at one point in each full revolution. Typically, the estimated position at all other points in the rotation is calculated based on the assumption of a constant speed over a measured period of time. The measured period of time is the time it takes the rotating elements to make a full revolution which is measured as the time between occurrences of the single index sensor pulses. Any variation of the actual speed from the assumed speed upon which the position calculation is based will result in an error of the calculated position. The error is proportional to the variation in speed.

Assuming the ring rotates at a constant speed, the time period between the once per revolution signal is measured. By dividing the time period by a constant, such as 360, incremental time steps can be derived. The time steps can be correlated to the angular position of the through-beam detector at the time of an object's detection.

If multiple indexing sensors are employed, the speed needs to be constant during the time it takes the ring to rotate from one indexing sensor to the next. Selecting the appropriate number of indexing points permits the use of a less expensive motor and eliminates the need for speed control electronics.

The transmitters 30 of the invention are radiation emitting lasers, light emitting diodes (LEDs), IR diodes, or visible LEDs and may emit a narrow beam of radiation or divergent or broadcast radiation. The detectors most commonly used are known as photo-detectors, and may vary in size, shape, and sensitivity. The types and choices of transmitters and detectors are known in the art, and the particular selection of either one for a given application is within the skill in that art.

The opposing detector 40 is positioned to detect the radiation from the transmitter after it overlaps the field. When an object is present in the field and is aligned with the through-beam detection device it interrupts the path of radiation from the transmitter to the detector. The detector 40 senses a decrease in the intensity of radiation from the transmitter 30. The signal generated by this interruption when coupled with information about the position of the through-beam detection device relative to a fixed point(s) is used to provide a first coordinate of the object in the field. By knowing the position of the field relative to an adjacent surface one can determine that the object is located somewhere along the line between the emitter and detector. The angle of the line at the point of detection is noted for later calculations.

By moving the through-beam detection device around the field, a second interruption in the beam intensity can be detected when a second path of radiation from the transmitter to the detector is interrupted. As with the case above, another line containing the object is determined. The angle of the second line is noted. The point where the two lines intersect can be calculated. This point is the location of the object in the field, which can then be used to determine the location of the object in an adjacent surface.

Although two interruptions of the through-beam by one object are ordinarily sufficient in a two dimensional field to determine two coordinates and thereby calculate the position of a single object in the field, it may be necessary to use multiple through beam detection devices (two are shown in FIG. 1) to insure the detection of multiple objects arranged in every possible orientation in a two dimensional system or to locate an object(s) in a three dimensional system.

In accordance with the invention, if the transmitter selected produces divergent or broadcast radiation, multiple opposing detectors may be used in vertically or horizontally stacked side-by-side fashion to expand the area being detected and to provide additional information about the object, such as its width or the angle of entry into the field. Thus, in accordance with the present invention, the single transmitter and multiple opposing detectors constitute a single through-beam detection device that rotates about the field as discussed above. For example, multiple detectors stacked one on top of the other can be used to determine the angle of entry of an object into the field which information is in turn used to locate the exact entry point of that object in a surface adjacent to the field. Alternatively, multiple stacked single beam transmitters may be used with stacked opposing detectors to accomplish the same objective.

Further, in accordance with the present invention, it is possible to use a single emitter or transmitter with multiple detectors to create multiple through-beam detection devices. In other words, the detectors may be positioned in such a way as to all share the radiant energy of one emitter. This has the advantage of slightly lowering the number of parts, costs, and energy consumption.

Figure 2:
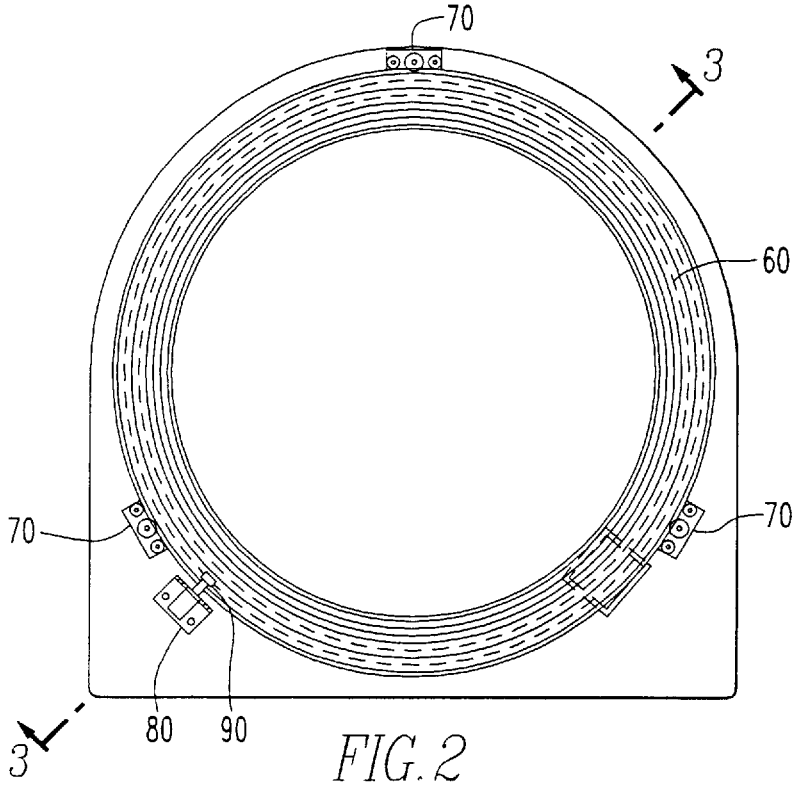
FIG. 2 is a front view of a rotating ring according to the invention.

A more detailed description of a ring useful for the practice of the invention shown in FIG. 1 is illustrated in FIG. 2. With reference to FIG. 2, and in accordance with the invention, there is disclosed an example of a means used to rotate the through-beam detection device (i.e., at least one transmitter and at least one opposing detector) around a circular field. A ring 60 is shown placed between guide rollers 70 that permit the ring to move freely and smoothly about its axis. Although not shown in FIG. 2, the transmitter and detector are mounted by known means on the surface of ring 60 so that they oppose each other. The transmitter and detector are mounted in fixed opposing positions so that the signal received by the-detector from the transmitter is always constant and steady except when an object blocks the path of the radiation received by the detector. The signal from the transmitter may be modulated to insure detection in the presence of potentially interfering radiation. Systems where transmitters and detectors move independently of each other are often plagued by inaccuracies caused by a weak or not constant transmitter to detector signal, due to the fact that the transmitter and detector are not always aimed at one another. The present invention overcomes this problem.

In accordance with the invention, instead of using guide rollers 70 to support the rotating ring, the inventors contemplate the use of air bearings or magnetic bearings. Although at the present believed to be more expensive than their counterpart guide rollers, such alternatives would make the apparatus quieter.

Figure 3:
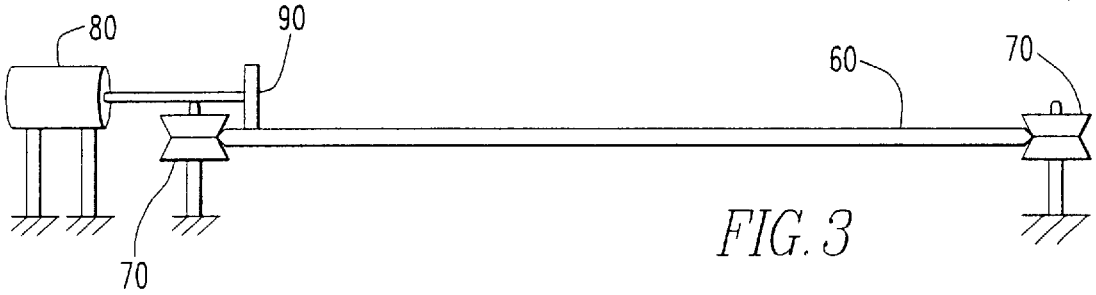
FIG. 3 is a simplified cross sectional view along line 3—3 of FIG. 2.

Means used to spin or rotate the ring at a constant rate per revolution include a drive motor 80. In one embodiment, the drive motor uses a rubber wheel 90 or an equivalent that frictionally engages the ring 60 on the top or bottom surface to cause it to rotate about its axis. The ring 60 is preferably made of a lightweight, durable material such as lightweight, durable plastic. An example of such a material is Lexan®. A cross section of the ring, guides, and motor and drive wheel are shown in FIG. 3.

Figure 3A:
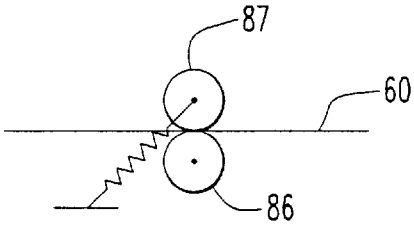
FIG. 3A is an elevational view of an alternative embodiment of a drive mechanism according to the invention.

Other known means may be used to rotate the ring 60. For example, it has been found that a pinch roller like that illustrated in FIG. 3A may be preferable where there is a need for better traction, constant speed, and a quieter drive mechanism. The pinch roller 85 shown in FIG. 3A has two rollers 86, 87. Preferably, one of the two wheels (86) is driven by a motor (not shown) and the other is idle (87). It does not matter which is on top and which is on bottom. Further, as shown, the idle wheel 87 may be spring biased with a spring 88 against the ring 60 and other wheel 86.

Figure 4:
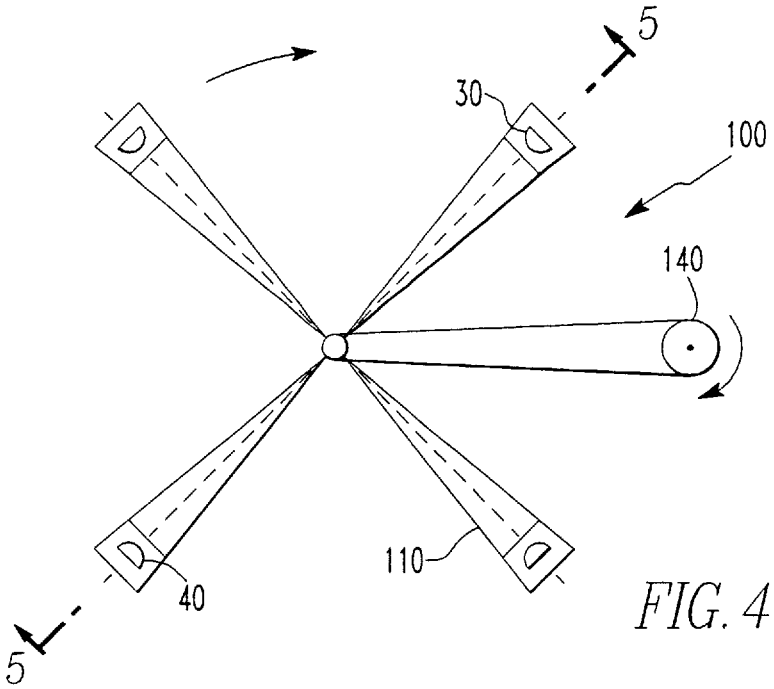
FIG. 4 is a front view of an alternative embodiment of the rotating ring according to the present invention.
Figure 5:
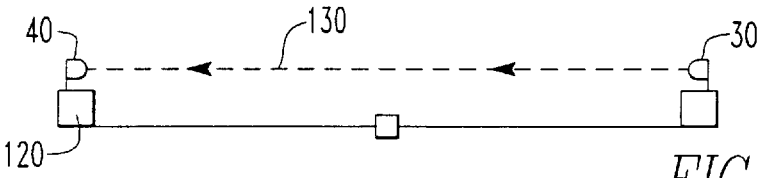
FIG. 5 is a cross sectional view along line 5—5 of FIG. 4.

Other means may be used to rotate the through-beam detection device(s) about an axis, such as the spoke-like device 100 having fixed arms 110 that rotate about its axis as shown in FIG. 4. The transmitter 30 and detector 40 are mounted as shown on the ends of the arms 110. Moreover, as shown in FIG. 5, the arms 110 may be stepped or raised at the ends 120 to elevate the through-beam detection device(s) above a surface (not shown) adjacent the beam field 130 that will be detected for the presence of objects. Means for rotating the spoke-like device about its axis such as a belt drive 140, powered by a drive motor (not shown), are known.

Figure 13:
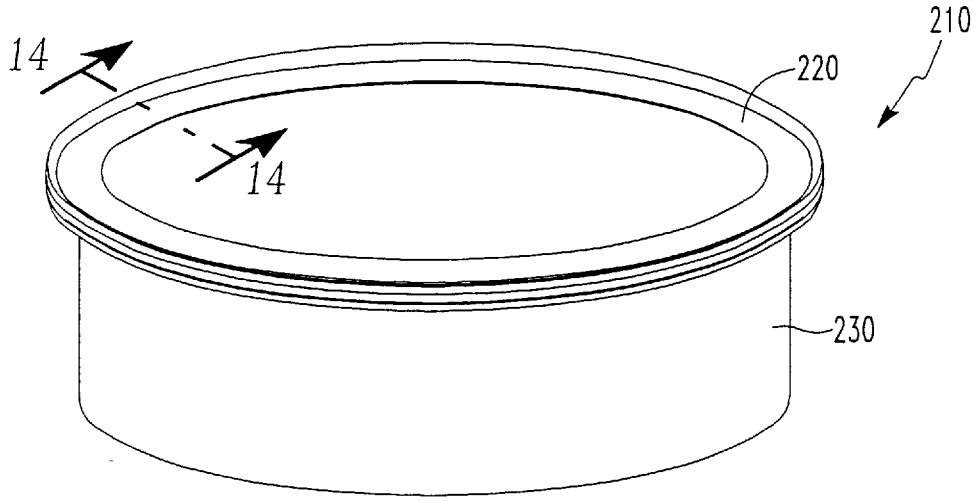
FIG. 13 is a simplified elevational view of an alternative embodiment of the rotating ring according to the invention.
Figure 14:
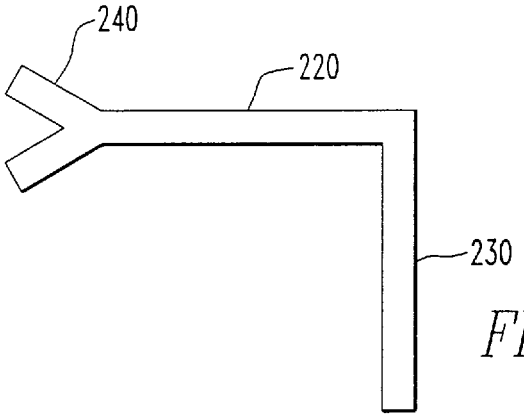
FIG. 14 is a cross sectional view along line 14—14 of FIG. 13.

FIG. 13 illustrates an alternative ring arrangement 210, useful with a belt drive as a means for rotating the ring. As depicted in FIGS. 13 and 14, the ring has the same surface 220 as ring 60 for mounting transmitters and detectors (not shown), and in addition has a vertically extending axial portion 230 for the belt drive (not shown). The inventors have discovered that the use of a "Y" groove 240 on the edge of the ring 210, which holds an "O" ring (not shown), reduces noise and improves the smoothness of the rotating ring. Otherwise, this ring is the same as ring 60.

Figure 6:
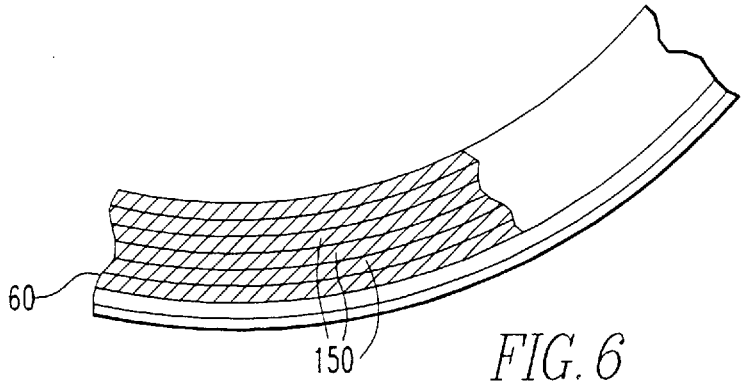
FIG. 6 is a detailed view of the rotating ring of FIG. 2.

FIG. 6 depicts an enlarged portion of the ring 60 shown in FIG. 2. The transmitter 30 and detector 40 (FIG. 1) are preferably powered by a constant power source such as a battery or AC/DC current through conductive leads 150 embedded or otherwise secured to the ring 60 by known techniques. Power may be supplied through a known slip ring set-up (not shown in FIG. 6) having pick-up contacts or brushes that are in constant contact with the conductive leads 150 while the ring rotates.

Figure 7:
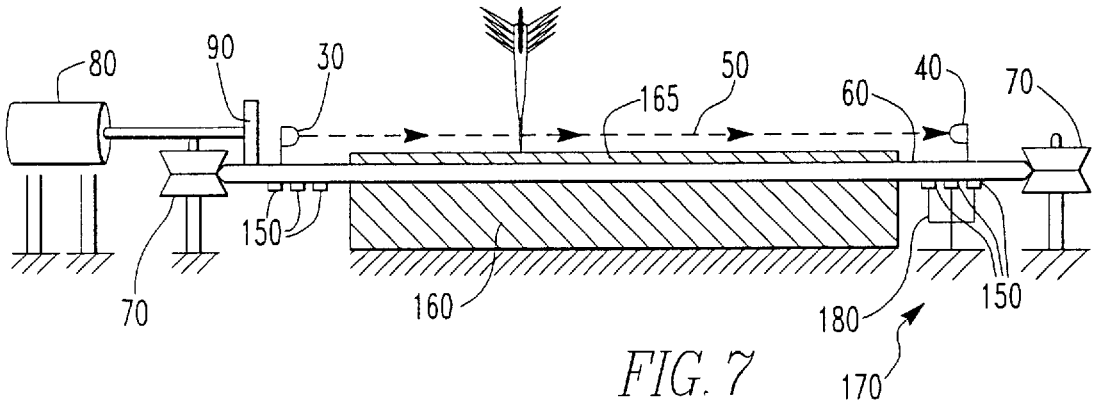
FIG. 7 is a simplified elevational view of another embodiment of the invention used to detect darts.

For illustration purposes only, in FIG. 7 there is disclosed a specific application of the invention to the detection and location of darts in a dart board surface. Of course, the disclosed invention has many general applications other than for the detection of darts, for example detecting the speed of an object through a field and determining the shape and relative position of an object in a field.

With respect to darts, a dart board 160 having a surface 165 is shown inserted and secured in a predetermined position inside the ring 60. The ring 60 preferably spins around the fixed dart board 160. Mounted on the ring is at least one through-beam detection device comprising at least one transmitter 30 and at least one opposing detector 40. For purposes of illustration only, the transmitter is an infrared light emitting diode, model number OP290A, manufactured by TRW. The detector is a photo-detector, model number OP598A, manufactured by TRW. As discussed above, multiple transmitters and opposing detectors may be used to suit a particular purpose, provided that the detectors and transmitters oppose each other to provide a constant through-beam that overlaps the field. For example, multiple opposing detectors may be stacked one on top of the other and/or side-by-side to provide a given level of detection required by a specific application.

The dart board in FIG. 7 is positioned inside the ring so that a beam 50 overlapping the field does not detect minor bumps or imperfections on the dart board surface other than the object to be detected, i.e., the dart. On the other hand, it is likely and in accordance with the invention, that known calibration protrusions or guides (not shown) on the dart board surface may be detected for purposes of calibrating the position of the board relative to the field so that the board is properly aligned and the location of the dart can be accurately determined. In a preferred embodiment, darts, placed in known positions will be used as the calibration guides. This will permit calibration for a specific board. After calibration, the darts will be removed; in this way no portion of the detection area is blocked. The detection beam should be as close to the surface to be monitored as possible to provide the most accurate reading of the dart's location in the surface of the board. Further, as explained above, multiple transmitters and/or detectors can be stacked, for example, to gather information about the angle of entry of the dart, which can then be used, knowing the distance of the field from the board's surface, to determine the exact location of the dart in the dart board surface.

The ring 60 is positioned in guide rollers 70 and is driven by drive motor 80 having a drive wheel 90. The drive motor is, for example, manufactured by ESCAP, model number 28L28-219. As shown in FIG. 7, the drive wheel is in frictional engagement with the top surface of ring 60 to rotate the ring. Of course, the drive wheel may be located underneath the surface of ring 60 as well, and a spring biased pinch roller can be added on the opposing surface to improve traction, maintain a constant speed, and/or reduce noise.

For the detection of darts, it was determined that the speed of the ring should be approximately 60 rpm, although this speed may vary depending on the means used to revolve the through-beam detection device about the field and the ultimate application of the device.

In the specific embodiment disclosed in FIG. 7, the transmitter 30 and detector 40 are powered by a power source (not shown) through the use of a known slip ring device generally shown as 170. The slip ring has two functions: one is to get power onto the ring to run the transmitters; and two is to return the detector signals from the ring. The slip ring has pick-up contacts or brushes 180 which are in constant contact with the conductive strips 150 of the ring 60 as the ring rotates. Consequently, through the slip ring device 170 a constant source of power is provided to the transmitter and detector and other circuits or devices which may require power. The slip ring also provides the means to convey the signal from the through beam detector (s) to the processing electronics located off the rotating ring. For purposes of the detection of darts on a dart board surface, it is expected that approximately 12 Watts is required to run this particular embodiment of the invention and to provide satisfactory results. It will be recognized, however, that energy requirements may vary from application to application and are within the routine in the art.

Further, as demonstrated below in an alternative embodiment, the processing electronics may be part of the rotating device. This reduces the number of slip rings required, saves money, and improves reliability.

Alternatively, and in accordance with the invention, batteries could be placed on the ring to power the transmitters and detectors, or power could be provided by inductively coupling power to the ring. Getting signals off the ring could be done by optical means, or by radio frequency techniques. Such alternatives may be costlier at present but eliminating the conductive contacts would reduce audible noise.

Figure 8:
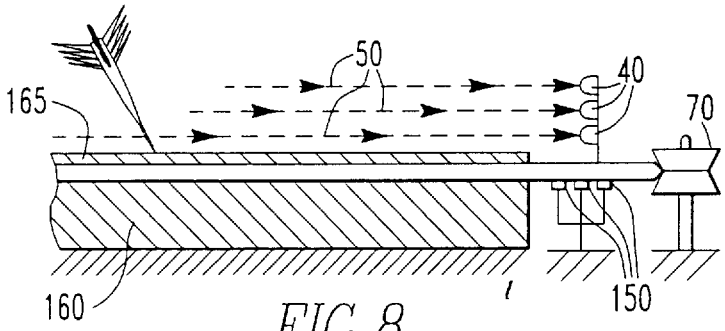
FIG. 8 is a simplified elevational view of an alternative embodiment of FIG. 7.
Figure 9A:
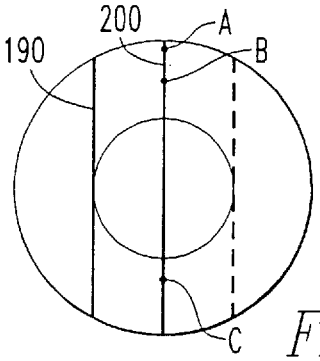
FIG. 9 is a series of drawings illustrating the detection of darts.
Figure 9E:
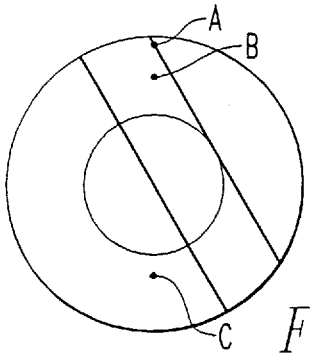
Figure 9B:
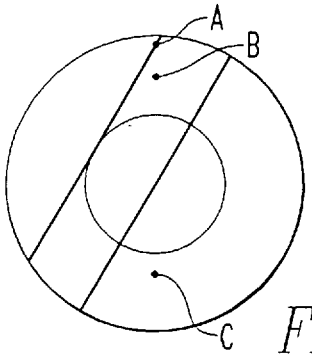
Figure 9F:
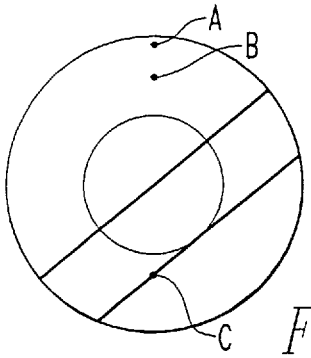
Figure 9C:
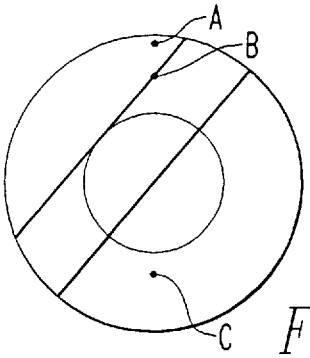
Figure 9G:
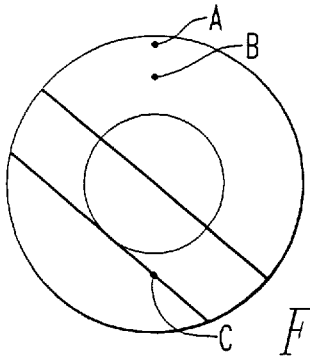
Figure 9D:
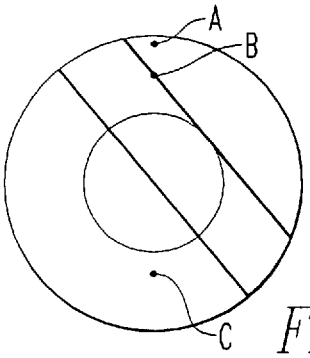
Figure 9H:
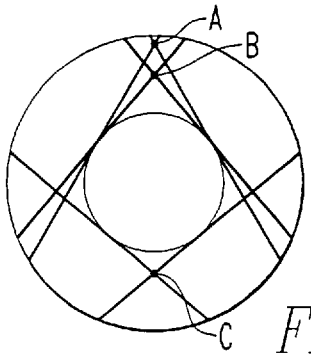
Figure 10A:
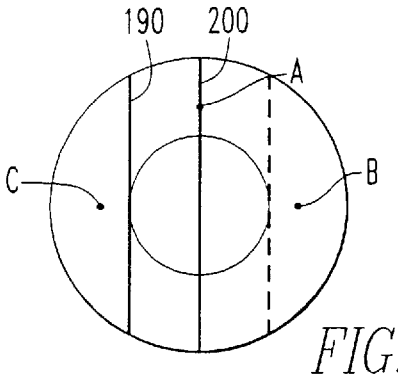
FIG. 10 is an alternative series of drawings illustrating the detection of darts.
Figure 10E:
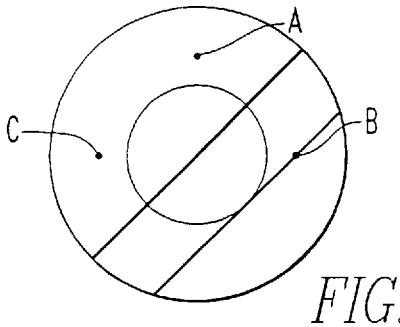
Figure 10B:
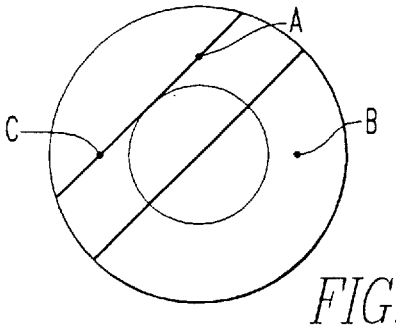
Figure 10F:
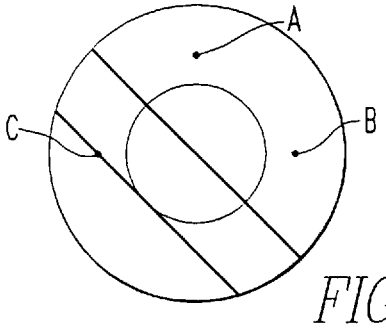
Figure 10C:
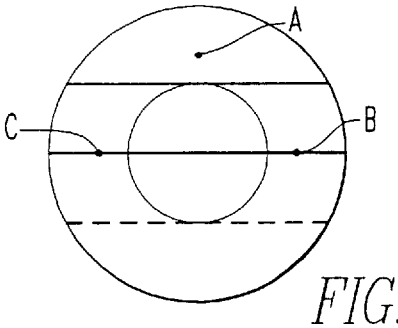
Figure 10G:
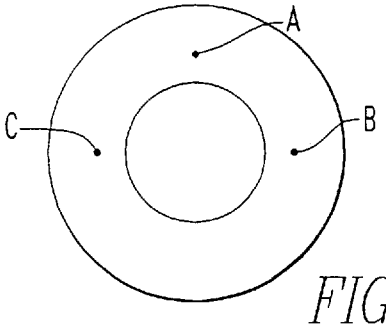
Figure 10D:
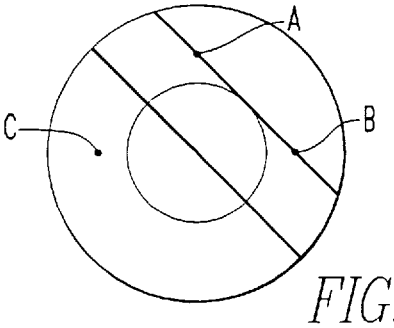
Figure 10H:
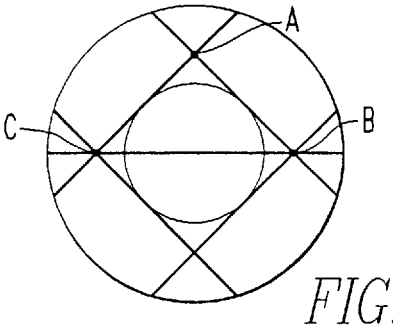

In accordance with the invention, there is disclosed in FIG. 8 a proposed modification to FIG. 7 where detectors 40 are vertically stacked (transmitter not shown, but single or multiple may be used) to provide information concerning the angle of the dart in the field and, ultimately, its point of entry into the surface of the dart board 165.

FIGS. 9 and 10 illustrate the detection of darts according to the present invention. More specifically, FIGS. 9 and 10 show in simplified form the detection of three (3) darts, A, B, and C (in two different scenarios) on a dart board using two through beam detection devices (each comprising at least one transmitter and at least one opposing detector) that create two detection beams 190, 200 that overlap the field above the dart board surface. At least two of the through-beam detection devices are horizontally offset from each other so as to create horizontally offset detection beams which are generally parallel to each other. Thus, if a dart is in the board and is located in line with the detector and transmitter pair, the radiation from the transmitter is interrupted which results in a change in the electrical signal to the detector, indicating that a dart has been detected. This information is then processed to give the dart's location in the dart board.

In the embodiments shown in FIGS. 9 and 10 one of the through-beam detection devices preferably is placed so that a beam 200 overlaps the field over the center of the dart board (bullseye). However, if only one through-beam detection device is used as described above and a dart is thrown as a perfect bullseye, this dart would effectively prevent the detector from detecting more than one dart in the board. Thus, at least one additional through-beam device positioned off-center (beam 190) is used to overcome this problem. In the case of a dart board, the off-center beam is preferably positioned so that the beam is at least tangent to the circumference of the bullseye as it rotates around the board. As shown in FIGS. 9 and 10, the use of at least two through-beam detection devices provides at least three beam interruptions by each dart which in turn permits the accurate determination of the darts' location in the field and, subsequently, the dart board surface.

FIG. 9 illustrates a series of three darts in line vertically. For example, FIG. 9*a* shows the center beam hitting all three darts at 300° and 180°. FIG. 9*b* shows the off center beam hitting the top dart at 30°. FIG. 9*c* shows the off center beam hitting the middle dart at 40°. FIG. 9*d* shows the off center beam hitting the middle dart a second time at 140°. FIG. 9*e* shows the off center beam hitting the top dart again at 150°. FIG. 9*f* shows the off center beam hitting the lowest dart at 220°. FIG. 9*g* shows the off center beam hitting the lowest dart at 300°. FIG. 9*h* shows a combination of all beam hits.

FIG. 10 illustrates a series of darts in line with the off center beam. For example, FIG. 10*a* shows the center beam hitting the top dart at 0° and 180°. FIG. 10*b* shows the off center beam hitting the top and left dart. FIG. 10*c* shows the center beam hits the left and right darts at 90° and 270°. FIG. 10*d* shows the off center beam hitting the top and right darts. FIG. 10*e* shows the off center beam hitting the right dart. FIG. 10*f* shows the off center beam hitting the left dart. FIG. 10*g* shows the dart pattern. FIG. 10*h* shows the combination of all beam hits.

The present invention is particularly useful in detecting the presence of multiple darts (three are commonly used in most dart games) in a dart board. For example, the present invention is capable of resolving or detecting objects (darts) that are hiding behind one another—a situation that can cause problems for other detection systems, i.e., systems required to detect more than one object. Accordingly, applicants believe that they have designed a detection system that can accurately detect and locate multiple objects in a field, such as a dart board surface.

Figure 11:
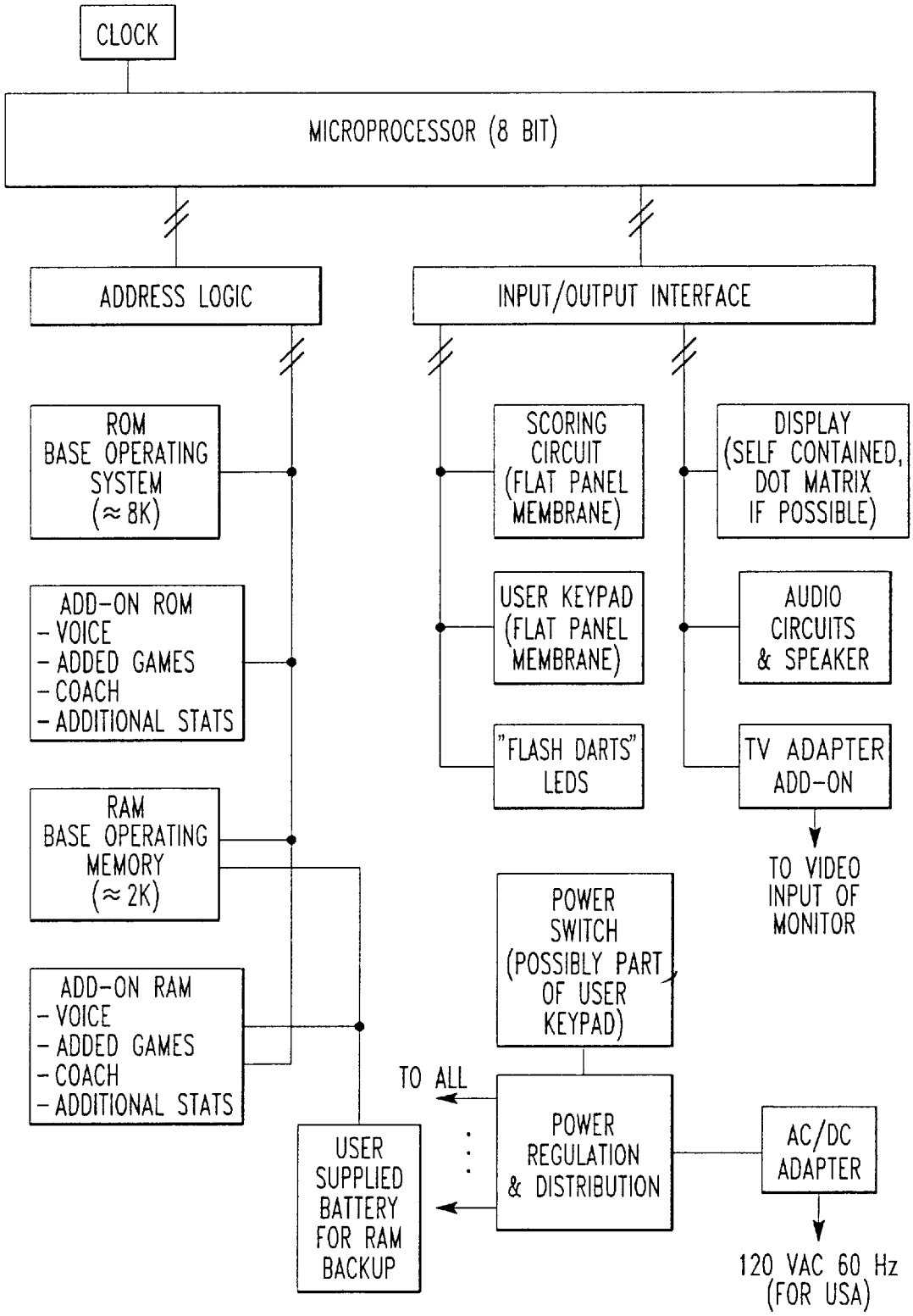
FIG. 11 is a block diagram of an example of electronics useful for one embodiment of the invention.
Figure 12:
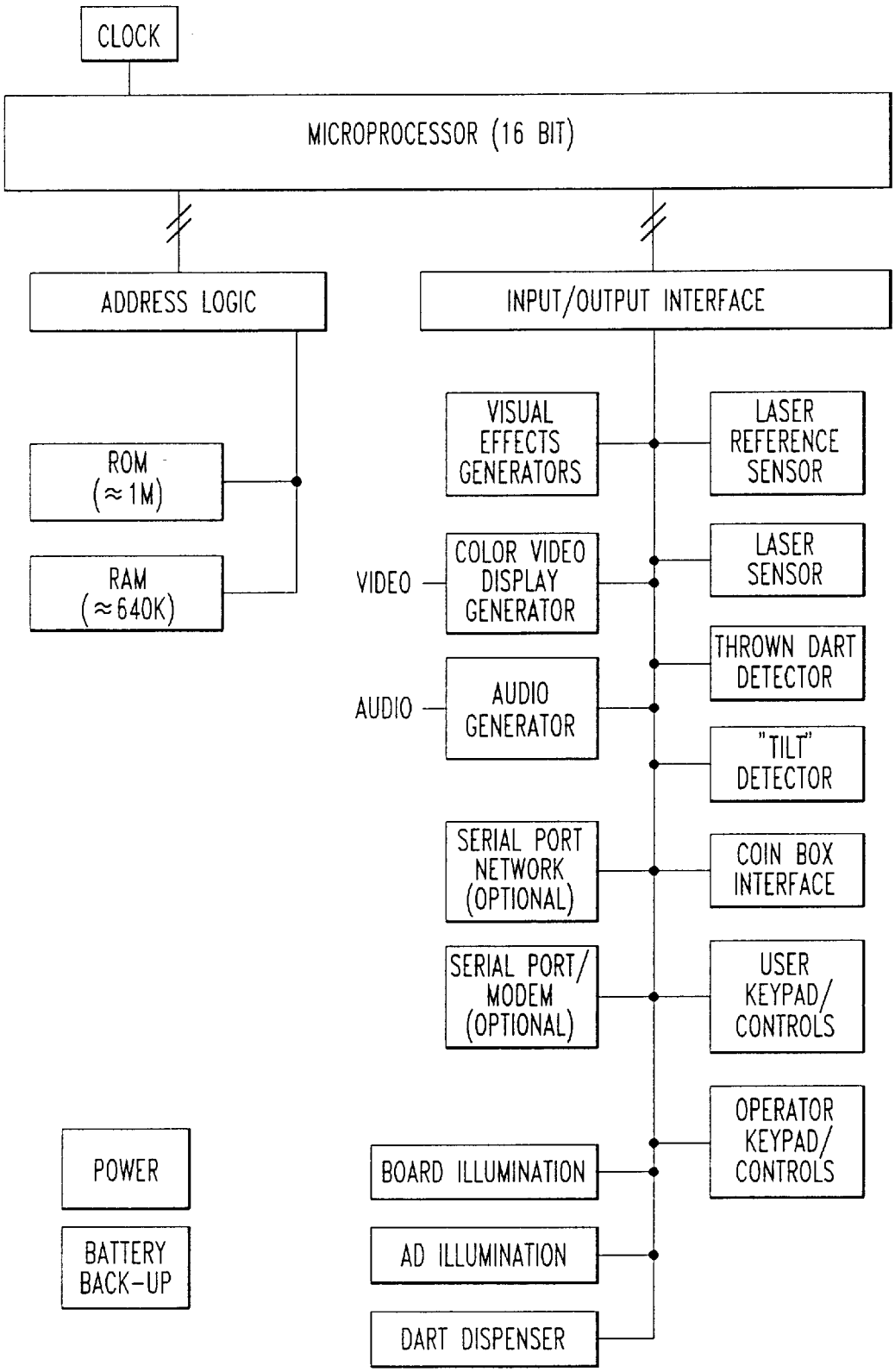
FIG. 12 is a block diagram of an alternative example of electronics useful for one embodiment of the invention.

The programs and calculations used to determine an object's location in a field or adjacent surface, e.g., a dart board surface, from the information obtained by the through-beam detection device are not the subject of this application. Without being limited, however, exemplary block diagrams of the electronics useful for applications according to and within the present invention and embodiments herein are illustrated in FIGS. 11 and 12.

Figure 15:
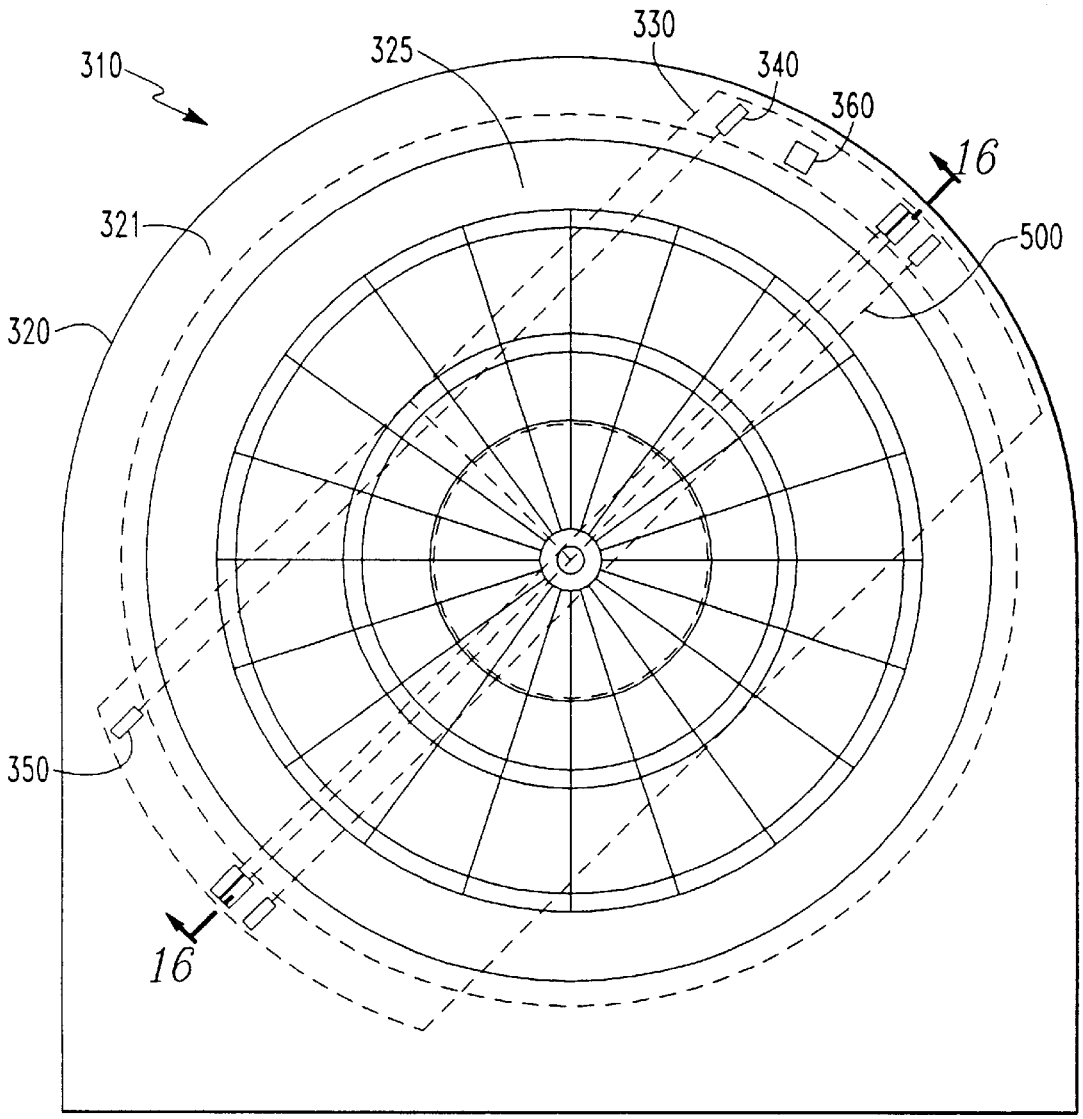
FIG. 15 is a front view illustration of another embodiment of the invention for use in the detection of objects in a circular field.
Figure 16:
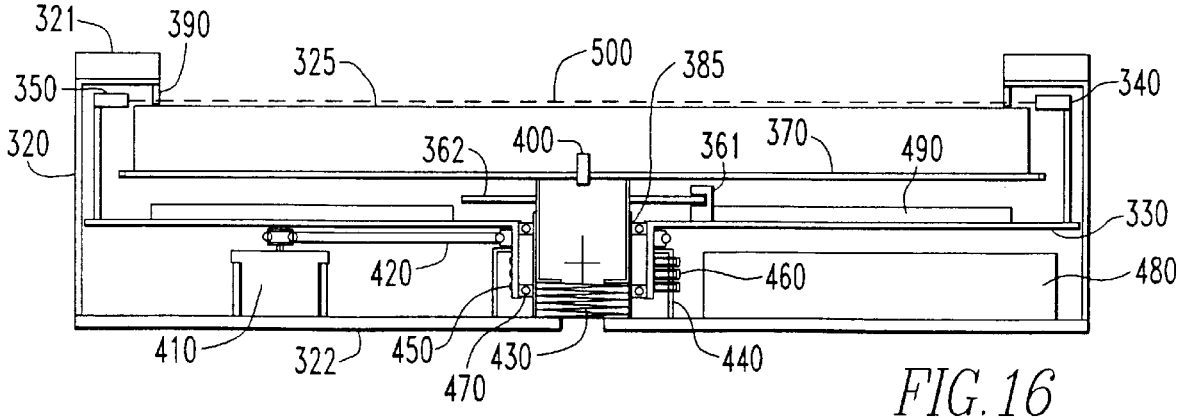
FIG. 16 is a cross sectional view along line 16—16 of FIG. 15.

FIGS. 15 and 16 will be used to describe yet another embodiment of the invention which may be used, for example, for the detection of darts. This embodiment is preferred for detecting darts over the other embodiments described herein because it is deemed to offer the best combination of features and characteristics of those discussed.

As illustrated in FIGS. 15 and 16, the dart board assembly 310 comprises, inter alia, a base plate 322, a dart board 325, a rotating platform 330, detector 340 (four are shown), transmitter 350 (four are shown), an encoder 360, a dart board platform 370, and a cover 320. FIG. 16 shows the dart board assembly 310 in greater detail in cross section along line 16—16 of FIG. 15. In addition to those elements identified above, there is disclosed an encoder head 361, an encoder disk 362, an optional, transparent lens 390, center pin 400, drive motor assembly 410, drive belt 420, spring 430, slip ring assembly 440 comprised of rotating conductive slip rings 450 (three are shown) and non-rotating contact brushes 460 (three are shown), bearings 470 (two are shown), electronics 480 and 490, and a detection beam 500.

The base plate 322 constitutes the main support for the dart board assembly 310 and also the back of cover 320, and may be made of any durable, light weight, rigid material such as aluminum, plastic, or wood.

In the present embodiment, the means for moving the through-beam detection device comprising at least one transmitter 350 and at least one detector 340 is a rotating platform 330 that is approximately rectangular in shape, although the exact shape and size is not critical so long as it rotates the through beam detection device around the area to be detected. The platform 330 may be made of any durable, lightweight, rigid material such as aluminum, plastic, or wood, although aluminum is preferred.

The transmitter 350 and detector 340, in this case four of each, are mounted on the rotating platform 330 to provide the requisite number of detection beams 500, in this case four. The number of through-beam detection devices required to accomplish any given job can be readily determined, taking into account the size and number of objects you may be required to detect, but generally should be kept to a minimum to keep the design simple. Although the transmitter 350 and detector 340, respectively, are all on the same side of the rotating platform 330 for simplification of design and assembly, there is no requirement that they all must be on the same side. The transmitters used in this embodiment are Model No. OP 290 A, from Optek Technology, Inc. The detectors used in this embodiment are Model No. OP 598 A, also from Optek Technology, Inc.

Encoders such as the encoder 360 used in the current embodiment are well known in the art for use as position locators. In the preferred embodiment, an angular position encoder is used. In a more preferred embodiment, the angular position encoder is a digital incremental encoder, such as Model No. MOD 91-551 encoder set, manufactured by BEI Sensors and Systems Company. It is comprised of two parts: a code disk 362 and a read head 361. The code disk has a series of marks (not shown) equally spaced around its circumference. The read head detects these marks and generates an electrical signal in the form of a pulse each time it see of the marks.

One part of the encoder rotates with the through-beam detection device, i.e., it is mounted on the rotating platform 330, while the other part is fixed. It does not matter which part rotates, but it simplifies the design if the read head 361 and the scoring computer 490 are on the same side of the slip ring assembly 440 so that the stream of encoder pulses do not have to pass through the slip rings 450. In one embodiment, the code disk rotates and the read head is stationary because the computer is not on the rotating portion of the mechanism. In the embodiment shown in FIG. 16, both the computer 490 and the encoder read head 361 are on the rotating platform 330 while the code disk 362 is stationary.

Digital incremental encoders come in a variety of forms. Some are transparent with non-transparent marks on the encoder disk which interrupt a beam built into the read head. Some are non-transparent disks with slots or holes which allow a beam in the read head to pass at each mark. Others are retro-reflective where a beam in the read head reflects off the marks, but not between, or vice versa. The encoders can also be magnetic, mechanical, etc. Any type is acceptable in the present invention, although digital incremental encoders are preferred.

The digital incremental encoder is preferred because it is believed to be the easiest and most cost effective for the electronics chosen. Other encoder types, like absolute encoders, or analog types, such as resolvers, can also be used. The idea is to measure the angular position of the through-beam detection device relative to the dart board, or other field being detected, and correlate the detection beam samples to that position.

In the preferred embodiment, the electronics 490 include any power conditioning required, signal conditioning for the through-beam detection devices, a scoring processor (e.g., a microcomputer for determining dart locations), signal conditioning for the encoder pulses, and transmitter circuits to send the score (or dart locations) to the non-rotating electronics 480. A receiver circuit could also be on 490, but is not required in all embodiments—only those that require two-way communications between 490 and 480. The dart location data is transmitted to 480 via slip rings or other means. Ideally, the data will be contained in a serial stream to minimize the number of transmission channels, e.g., slip ring circuits, required. The electronics 480 can have a broad array of configurations, but require at a minimum the means to receive the data transmitted by the rotating electronics 490. For example, electronics 480 can include the gaming software, user interface (display, push buttons, etc.) or simply be a conduit for the data from the electronics 490 to whatever other electronics provide such functions.

The speed of the rotating platform 330 is not required to be kept constant as that term is used herein, but it does simplify the task of accurately determining the position of objects in the beam field. In a preferred embodiment, approximately 20,000 samples per detection beam 500 per revolution of the rotating platform 330 are taken. However, only approximately 4000 pulses from the position encoder are received. Therefore, about 5 samples per encoder pulse are taken. Of course, the skilled artisan will recognize that these values will vary depending on the type of encoder selected. Each time the detection beams are sampled, the angular position for that sample needs to be determined. Each time an encoder pulse is "seen" the angular position relative to the dart board is known. For the samples that fall in between encoder pulses, the angular position for that sample must be calculated. The calculation used assumes a constant speed because it makes the equation linear, and therefore, simple. The angular position for each sample is determined from the number of encoder pulses per revolution, the elapsed time between the preceding and following encoder pulses, and the time between the preceding encoder pulse and the sample of the detection beam. In reality, the speed is not 100% constant. No attempt is made to even try to regulate the speed. The calculated angular position, however, is still sufficiently accurate if a large number of encoder pulses are used because the angular position is known at each encoder pulse location, thereby limiting the potential cumulative error that would result from speed variations. If the speed did vary greatly, accurate calculations could still be made if the speed was constantly measured using a more complicated equation. In the simplest implementation, there would be ideally one encoder pulse for each detection beam sample and no interpolation of the timing between encoder pulses would be required, and any variation of speed would have no consequence.

The embodiment shown in FIGS. 15 and 16 also contains a dart board platform 370 for mounting a dart board 325. The platform may be made of any light weight, durable, rigid material such as aluminum, plastic, or wood. The platform 370 also contains a centering pin 400 for aligning the board on the platform.

The cover 320 plays an innovative role in the present embodiment. In a preferred embodiment, the cover is in two parts, the back 322 and the front 321. The front cover 321 protects the rotating components from people and darts, and similarly protects people from the rotating components. An optional, cylindrical lens 390, which is transparent to the sensor beams, is mounted to the underside of the large round opening that exposes the face of the dart board 325. This cylindrical lens contacts the face of the dart board continuously around the edge of its face when the cover is assembled.

The dart board is mounted on a dart board platform 370 that has a tube or other shaped component 375 mounted on the back which slides into or over (in a male-female relationship) a similarly shaped component 385 which is mounted to the back cover or base plate 322. The exact shape is not critical but a tube or cylindrical shape is preferred for simplicity reasons. The idea is to allow the dart board's platform 370 to move in only the forward and backward directions toward or away from a wall on which the dart board assembly 310 hangs. A spring or other device 430 is used to apply a force which pushes the dart board platform away from the base plate 322. The spring should be strong enough to prevent the dart board from moving backwards due to the impact force of a thrown dart.

The plane in which the detection beams 500 rotate is fixed by design at some distance from the back cover 322. In the case where a dart board is used, for example, it is desirable for the detection beams 500 to be as close as possible to the spider on the dart board surface to accurately score "leaners", but not so close that elevations on the spider or imperfections on the board surface cause false readings. The front cover 321, which optionally contacts the face of the dart board around its edge with the transparent, cylindrical lens 390, pushes the face of the dart board to a position slightly behind the plane of the rotating detection beams. In the case of a dart board, this distance is approximately 1/16 inch. This sets the intended distance between the face of the dart board and the detection beams once the cover is properly assembled. This technique allows for easy alignment of the dart board face in a plane which is parallel to and slightly behind the plane in which the detection beams rotate. It also allows for the thickness of the dart board to be different from one board to another. Alternatively, the transparent lense is eliminated and the dart board face is adjusted by other known means.

In the present embodiment, the dart board has a small (0.25 inch) hole drilled in the center of the back surface which is aligned with the center of the dart board spider on the front surface. The platform 370 on which the dart board is mounted has a small (0.25 inch) cylindrical pin 400 protruding from the center of its face. The hole in the rear of the dart board fits over this pin on the base to align the center of the dart board with the center of rotation of the detection beam device.

The optional cylindrical lens portion 390 of the front cover 321 holds the dart board against the platform while the spring 430 applies the reaction force from behind the platform. In this preferred embodiment, the dart board can be rotated by the user (or anyone) without opening the cover. The dart board rotates around the small pin, and is held in its rotational position by the friction of the lens 390 against the face of the board and of the platform against the back of the board.

In the embodiment shown in FIGS. 15 and 16, motor 410 turns platform 330 using belt 420. Rotating platform 330 holds electronics 490, encoder read head 361, and a number of through-beam detection devices comprising detectors 340 and transmitters 350. The rate of rotation is approximately 360 degrees per second. As platform 330 rotates, encoder read head 361 scans the encoder disk 362 and provides signals to the electronics 490. The encoder disk 362 is fixed relative to the dart board and does not rotate. As a result, signals from the encoder read head can be used to measure the rotational, angular position of platform 330 and all the components it transports with respect to the fixed dart board. Two types of signals are provided from the encoder read head 361 to the electronics 490. One type of signal is an index pulse that occurs once per revolution. This pulse is used to indicate the start of a revolution and is used as an angular index reference for all other readings and calculations. The other type of signal received from the encoder read head is the incremental angular position. This signal produces a pulse for every fixed number of degrees or fraction of a degree. In this embodiment, the encoder disk 362 contains one index marking and 1024 incremental markings which are sensed by the read head 361. The read head 361 and associated electronics 490 convert the 1024 incremental markings to 4096 pulses per revolution of the rotating platform 330. By counting the number of pulses that have occurred since the last appearance of the once per revolution index pulse, the electronics 490 can precisely determine the rotational position of platform 330 relative to the dart board surface 325. In this way the rotating electronics 490 can determine the precise location relative to the dart board of any of the components carried on the rotating platform 330 at any time. As the platform 330 rotates, the electronics 490 also collect signals from the through-beam detection devices. When any of the beams 500 are broken by a dart, the electronics 490 takes note of the rotational position of the platform 330 by employing the signals from the encoder read head 361. Once a full rotation of platform 330 has occurred, determined by the reappearance of the once per revolution index pulse, the electronics 490 calculate the location of the various darts as described above. Once the dart location has been determined, the dart location is sent to the non-rotating electronics 480 via the slip ring assembly 440 (rotating conductive slip rings 450 and non-rotating contact brushes 460) in a serial manner to reduce the number of slip rings 450 and contact brushes 460 required. Because slip rings can wear out and consist of components that have a cost associated with them, it is useful to minimize the number of slip rings 450 and contact brushes 460. Providing the dart location data in a serial format permits the use of a single slip ring assembly for conveying the scoring data. In this embodiment, three slip ring circuits are shown: one to convey the dart location data, one for system ground and one for system power. (However, three is not the minimum number of slip rings required. By combining one or both circuits with the dart location channel, the number of slip rings could be reduced to two. By using batteries and some other means to transmit the dart location information, such as RF or infrared, slip rings can be eliminated totally.) As described earlier, the electronics 480 can then process the information in a number of ways to effectively provide the user with information related to the location of the dart.

It will be apparent to those skilled in the art that modifications and variations can be made to the apparatus of the present invention without departing from the spirit or scope of the invention. Thus, it is intended that the present invention cover the modifications and variations of this invention provided they come within the scope of the appended claims and their equivalents.

It also will be apparent to those skilled in the art that the apparatus according to the present invention is a detection system which is more accurate and reliable, has simplified electronics and software, and is inexpensive to manufacture.

What is claimed is:

1. An apparatus for detecting the presence of at least one object in a field, the apparatus comprising:

at least two through-beam detection devices, each device comprising at least one transmitter and at least one opposing detector that are fixed relative to each other and that create a detection beam that overlaps the field, at least two of the devices being horizontally offset from each other so as to create horizontally offset detection beams; and means for moving said devices around the field to detect at least one object in the field.

2. The apparatus of claim 1 further comprising means to measure the angular displacement of said through-beam detection devices relative to a fixed point when an object is sensed in the field.

3. The apparatus of claim 2, wherein the means to measure the angular displacement is selected from the group consisting of at least one indexing sensor, at least one encoder, and combinations thereof.

4. The apparatus of claim 3, wherein said means to measure the angular displacement is at least one encoder.

5. The apparatus of claim 3, wherein said means is at least one digital incremental encoder.

6. The apparatus of claim 1, wherein the means for moving said devices around the field is selected from the group consisting of a ring and a platform, and at least two transmitters and at least two opposing detectors are mounted on the ring or platform.

7. The apparatus of claim 6 further comprising means to move said ring or platform.

8. The apparatus of claim 7, wherein the means to move said ring or platform is a motor.

9. The apparatus of claim 1 further comprising a slip ring assembly to power said transmitters and said detectors, said slip ring assembly having a portion thereof in contact with conductive leads in said means for moving the devices.

10. The apparatus of claim 1 further comprising means to measure the angular displacement of said through-beam detection devices selected from the group consisting of at least one indexing sensor, at least one encoder, and combinations thereof, wherein said means for moving said devices are selected from the group consisting of a ring and a platform, and a motor is used to move said ring or platform.

11. The apparatus of claim 1 wherein at least one of the through-beam detection devices includes at least two vertically stacked opposing detectors to permit the determination of the angle of entry of an object in the field.

12. The apparatus of claim 1 wherein at least two of the devices are located so that the horizontally offset beams are generally parallel to each other.

13. The apparatus of claim 1 wherein one of the devices is located so as to create a detection beam which passes through the center of the field, and another of the devices is located so as to create a detection beam which does not pass through the center of the field.

14. An apparatus for detecting the presence of at least one object in a field, the apparatus comprising:

at least one through-beam detection device comprising at least one transmitter and at least one opposing detector that are fixed relative to each other and that create a detection beam that overlaps the field;

means for moving said device around the field to detect at least one object in the field; and at least one digital incremental encoder for measuring the angular displacement of said through-beam detection device relative to a fixed point when an object is sensed in the field, wherein the encoder comprises at least one read head and at least one code disk.

15. An apparatus for detecting the presence of at least one object in a field, the apparatus comprising:

at least one through-beam detection device comprising at least one transmitter and at least one opposing detector that are fixed relative to each other and that create a detection beam that overlaps the field;

means for moving said device around the field to detect at least one object in the field; and at least one indexing sensor for measuring the angular displacement of said through-beam detection device relative to a fixed point when an object is sensed in the field.

16. An apparatus for detecting the presence of at least one object in a field, the apparatus comprising:

at least one through-beam detection device comprising at least one transmitter and at least one opposing detector that are fixed relative to each other and that create a detection beam that overlaps the field;

means for moving said device around the field to detect at least one object in the field; and an encoder and a slip ring assembly, and wherein said means for moving said device is a rotating platform assembly.

17. The apparatus of claim 16 further comprising a second platform assembly and a cover comprising a front and back.

18. The apparatus of claim 17, wherein the front of said cover further comprises a transparent lens.

19. The apparatus of claim 17 further comprising a surface placed adjacent to the field being detected and on said second platform assembly to permit the detection of at least one object in said surface.

20. An apparatus for detecting the presence of at least one dart in a dart board surface, the apparatus comprising:

at least two through-beam detection devices, each device comprising at least-one transmitter and at least one opposing detector that are fixed relative to each other and that create a detection beam that overlaps a field adjacent a dart board surface, at least two of the devices being horizontally offset from each other so as to create horizontally offset detection beams; and means for moving said devices around the field to detect said at least one dart in the field and the dart board surface.

21. The apparatus of claim 20 further comprising means to measure the angular displacement of said through-beam detection devices relative to a fixed point when an object is sensed in the field.

22. The apparatus of claim 21, wherein the means to measure the angular displacement is selected from the group consisting of at least one indexing sensor, at least one encoder, and combinations thereof.

23. The apparatus of claim 22, wherein said means to measure the angular displacement is at least one encoder.

24. The apparatus of claim 22, wherein said means to measure the angular displacement is at least one digital incremental encoder.

25. The apparatus of claim 20 wherein the means for moving said devices around the field is selected from the group consisting of a ring and a platform and said transmitters and detectors are mounted on the ring or platform.

26. The apparatus of claim 25 further comprising means to move said ring or platform.

27. The apparatus of claim 25, wherein the means to move said ring or platform is a motor.

28. The apparatus of claim 20 further comprising a slip ring assembly to power said transmitters and said detectors, said slip ring assembly having a portion thereof in contact with conductive leads in said means for moving the devices.

29. The apparatus of claim 20 wherein said dart board surface is located sufficiently close to the field to permit an accurate determination of the dart's location in the board without interference caused by imperfections on the board's surface or by the spider.

30. The apparatus of claim 20 further comprising means to measure the angular displacement of said devices selected from the group consisting of at least one indexing sensor, at least one encoder, and combinations thereof, wherein said means for moving said devices are selected from the group consisting of a ring and a platform, and a motor is used to move said ring or platform.

31. The apparatus of claim 20 wherein at least one of the through-beam detection devices includes at least two vertically stacked opposing detectors to permit the determination of the angle of entry of at least one dart in the field and dart board surface.

32. The apparatus of claim 20 wherein at least two of the devices are located so that the horizontally offset beams are generally parallel to each other.

33. The apparatus of claim 20 wherein one of the devices is located so as to create a detection beam which passes through the bullseye of the dart board, and another of the devices is located so as to create a detection beam which does not pass through the center of the field.

34. The apparatus of claim 33 wherein said another of the devices is located so as to create a detection beam which passes at least tangent to the circumference of the bullseye.

35. An apparatus for detecting the presence of at least one dart in a dart board surface, the apparatus comprising:

at least one through-beam detection device comprising at least one transmitter and at least one opposing detector that are fixed relative to each other and that create a detection beam that overlaps a field adjacent a dart board surface;

means for moving said device around the field to detect said at least one dart in the field and dart board surface; and at least one digital incremental encoder for measuring the angular displacement of said through-beam device relative to a fixed point when an object is sensed in the field, wherein the encoder comprises at least one read head and at least one code disk.

36. An apparatus for detecting the presence of at least one dart in a dart board surface, the apparatus comprising:

at least one through-beam detection device comprising at least one transmitter and at least one opposing detector that are fixed relative to each other and that create a detection beam that overlaps a field adjacent a dart board surface;

means for moving said device around the field to detect the at least one dart in the field and dart board surface; and an encoder and a slip ring assembly, and wherein said means for moving said device is a rotating platform assembly.

37. The apparatus of claim 36 further comprising a second platform assembly and a cover comprising a front and back.

38. The apparatus of claim 37, wherein the front of said cover further comprises a transparent lens.

39. An apparatus for detecting the presence of at least one dart in a dart board surface, the apparatus comprising:

at least two through-beam detection devices, said devices each comprising at least one transmitter and at least one opposing detector that are fixed relative to each other and that each create a detection beam that overlaps a field and are located adjacent a dart board surface, at least two of the devices being horizontally offset from each other so as to create horizontally offset detection beams; and means for moving said devices around the field to detect said at least one dart in the field; and means for measuring the angular displacement of said devices relative to a fixed point or points when an object is detected in the field.

40. The apparatus of claim 39 wherein at least one of said devices comprise at least two vertically stacked opposing detectors to permit the determination of the angle of entry of at least one dart in the field.

41. The apparatus of claim 39 wherein at least two of the devices are located so that the horizontally offset beams are generally parallel to each other.

* * * * *